United States Patent [19]

Brunner et al.

[11] 4,353,073

[45] Oct. 5, 1982

[54] ANTENNA ARRANGEMENT FOR A RADAR SURVEILLANCE METHOD FOR TARGET LOCATING WITH ALTITUDE ACQUISITION

[75] Inventors: Anton Brunner, Wangen; Erwin Kress, Woerthsee, both of Fed. Rep. of Germany

[73] Assignee: Siemens Aktiengesellschaft, Berlin & Munich, Fed. Rep. of Germany

[21] Appl. No.: 201,280

[22] Filed: Oct. 27, 1980

[30] Foreign Application Priority Data

Nov. 13, 1979 [DE] Fed. Rep. of Germany ..... 2945789

[51] Int. Cl.[3] ..... H01Q 3/24; H01Q 19/15

[52] U.S. Cl. ..... 343/779; 343/840; 343/854

[58] Field of Search ..... 343/770, 778, 779, 840, 343/853, 854

[56] References Cited

U.S. PATENT DOCUMENTS

| | | | |
|---|---|---|---|
| 2,870,441 | 1/1959 | Hines | 343/779 |
| 2,965,899 | 12/1960 | Bohm et al. | 343/781 P |
| 3,016,531 | 1/1962 | Tomiyasu et al. | 343/779 |
| 3,916,416 | 10/1975 | Lewis | 343/779 |
| 4,156,243 | 5/1979 | Yorinks et al. | 343/779 |

FOREIGN PATENT DOCUMENTS

| | | |
|---|---|---|
| 2016391 | 10/1971 | Fed. Rep. of Germany . |
| 1326496 | 8/1973 | United Kingdom . |

OTHER PUBLICATIONS

Silver, S., "Microwave Antenna Theory and Design," McGraw-Hill Book Co., 1949 pp. 388, 402–410, 459–464.

*Primary Examiner*—Eli Lieberman

*Attorney, Agent, or Firm*—Hill, Van Santen, Steadman, Chiara & Simpson

[57] ABSTRACT

An antenna arrangement for a radar surveillance method for target locating having altitude acquisition provides that, for the purpose of level comparison, a plurality of overlapping lobes lying above one another are generated by a reflector rotating around a vertical axis together with a primary radiator row arranged essentially vertically. In employing a paraboloid of revolution as the reflector, a vertical primary radiator row is arranged around its focal point. Given more greatly deflected beams whose exciters are at a greater distance from the focal point, the gain in such an antenna decreases as the side lobes increase, limiting the elevation angle range. A single parabolic cylinder reflector generating a beam and focusing only in the horizontal plane is employed as the reflector, the individual radiators of a primary radiator row being arranged along its focal line. The horizontal extent of the primary radiators is so small and the vertical extent is so great that the desired bundling of the individual lobes lying one above another arises. The antenna arrangement according to the invention can be advantageously employed in an X-band radar having altitude acquisition.

17 Claims, 7 Drawing Figures

ANTENNA ARRANGEMENT FOR A RADAR SURVEILLANCE METHOD FOR TARGET LOCATING WITH ALTITUDE ACQUISITION

BACKGROUND OF THE INVENTION

1. Field of the Invention

The present invention relates to an antenna arrangement for a radar surveillance technique for target locating having altitude acquisition in which, for the purpose of level comparison, a plurality of mutually overlapping radiation lobes lying above one another are generated by a reflector rotating together with an essentially vertically arranged primary radiator row around a vertical axis.

2. Description of the Prior Art

Standard radar surveillance antennas only supply the azimuthal position of the target but not, however, its angle of elevation. Given increasing flight density and for a more accurate vectoring of target tracking system, however, the additional information concerning the altitude of the target and the angle of elevation of the target is of ever-increasing significance.

Surveillance antennas are usually constructed as reflector antennas having a double-curvature reflector. The expansion of such an antenna for altitude determination by means of additional primary radiators is not practically possible because of the vertical reflector curvature which, given the necessary deflection, produces phase errors which are too great.

It is known to employ two separate radar systems for target locating according to azimuth and elevation angles, whereby one surveillance radar serves for determining the azimuthal angle and an altitude search radar having a vertically slewable beam serves for providing the elevation angle, the altitude search radar being vectored by the surveilance radar. Thereby, however, temporal delays and difficulties arise in the construction of the double antenna arrangement, particularly in the design of the swivel base of the altitude acquisition antenna.

In so-called 3-D radar, only a single, common antenna arrangement is provided for acquiring the azimuth and the elevation of a target, whereby only a mechanical beam slewing is considered for the horizontal acquisition and electronically phase-controlled beam slewing is preferred to the mechanical beam slewing for the vertical plane because of the swiveling of a large antenna thereby required with the mass accelerations resulting therefrom. In addition to the high expense of the phase control, the disadvantage of such an arrangement is that the scanning must occur relatively quickly because of the additional horizontal search movement and, therefore, the dwell time necessary on the target for a secure identification of the target position is not achieved.

However, surveillance radar antennas are possible in which both the horizontal and vertical beam motions occurs by a phase-controlled single radiator group. This, however, represents an extremely high expense which is not appropriate for many constructions.

A better possibility for the simultaneous acquisition of azimuth, range and elevation of a target occurs by employing a plurality of receiving lobes lying above one another and overlapping in the vertical pattern, whereby the angles of elevation of the lobe intersections are known and the angular distance of one of these points of intersection can be identified by level comparison of the two appertaining lobe echoes. In this method, it is known in the receiving and transmitting cases, to employ the same antenna with a single parabolic reflector and a plurality of primary radiators which entirely, or partially, illuminate the parabolic reflector from different angular positions, so that variously inclined lobes, and lobes of differing width, are generated. Usually, a section of a paraboloid of revolution is thereby employed as the reflector and a vertical primary radiator row (stacked beam) is arranged around the focal point of the reflector, so that the desired radiation lobes lying above one another and overlapping somewhat arise. Given more greatly deflected beams whose excitors are at a greater distance from the focal point of the reflector, however, the gain decreases and the side lobes increase, thereby limiting the available angle of elevation range. Since the individual lobes are usually employed in the receiving mode, the transmitting antenna, if it is not to be realized by an additional reflector antenna, must be realized by the interconnection of the individual primary radiators in the transmit case given separate receiving evaluation. Such an interconnection of primary radiators, however, leads to an extravagent switching matrix and to lobings of the transmit antenna pattern.

Such surveillance radar antennas are described in the German Letters Patent No. 2,016,391.

SUMMARY OF THE INVENTION

The object of the present invention is to provide an antenna arrangement for a radar surveillance method for target locating having altitude acquisition which makes do without the technical expense required given phase-controlled antennas and which nevertheless satisfactorily functions over a relatively great angle of elevation range with respect to gain and with respect to side lobe behavior.

According to the invention, which relates to an antenna arrangement of the type generally mentioned above, the above object is achieved in that the reflector is designed as a parabolic cylinder reflector generating a beam focusing only in the horizontal plane, the primary radiator row being arranged along its focal line, in that the individual radiators of the primary radar row which are designed relatively narrow with respect to their horizontal expanse are inclined in the vertical plane in such a manner that the respectively desired primary beam radiation of the individual lobes lying above one another and generated thereby arises in the vertical pattern, and in that the individual radiators of the primary radiator row are dimensioned in their vertical extent in such a manner that a desired bundling of the individual lobes lying one above another arises.

The antennas arrangement according to the present invention, therefore, also has the advantage that a parabolic cylinder reflector can be relatively easily manufactured.

The number of individual radiators in the primary radiator row depends on the accuracy of the desired angle of elevation determination and of the angle of elevation range to be covered.

The individual radiators of the primary radiator row can be advantageously executed as flap parabolic antennas (cheese box antennas, pillbox antennas), which comprise metal plates extending parallel to one another which are terminated by a parabolic cylinder strip and which are fed by a small horn radiator in the focal line of the parabolic strip. The flat parabolic antennas can be symmetrically or asymmetrically constructed (offset feed). Such radiators are described in detail, for example, in the book by S. Silver entitled "Microwave Antenna Theory and Design", 1949, McGraw-Hill Book Co., pp. 459–464. Alternately, flat horn radiators with or without lenses in front can be employed. For the sake of simplicity, this radiator form is not separately illustrated on the drawings. Flat horn radiators (sectoral horns) are described on Pages 350 and 351 of the above-mentioned S. Silver book. Lenses for emplacement in front of flat horn radiators are mentioned on Page 388 of the same publication and are described in detail on subsequent pages.

An improvement of the azimuthal focusing can be achieved when the flat parabolic antennas more or less inclined relative to the focal line of the parabolic cylinder reflector are extended on the side of the opening in such a manner that the aperture planes contain the focal line of the parabolic cylinder reflector. This, however, is only possible for the horizontal polarization which is usually employed. For other polarizations, phase errors would occur. The arrangement of the primary radiator row in front of the parabolic cylinder reflector can occur either symmetrically or asymmetrically (offset) in front of the parabolic cylinder reflector. The advantage of the asymmetrical arrangement is that the primary radiator row lies outside of the beam path after the reflection and, therefore, causes no aperture covering.

The outputs of the individual radiators of the primary radiator row are either simultaneously connected to a respective receiver or are connected in chronological succession to an overall receiver, or two neighboring radiators are respectively connected in chronological succession due to receivers.

Due to the overlap of the primary lobes of neighboring radiators, given a simplest evaluation, the radiator having the greatest receive signal level roughly indicates the elevation angle range of a target. Given a monopulse evaluation, i.e. a quantitative level comparison of the receive signals of neighboring radiators, a precision of 1/5–1/10 of the individual lobe width can be achieved.

The transmitter power is advantageously beamed by an additional radiator which likewise co-employs the parabolic cylinder reflector. This can occur by a cosecant-squared pattern, as is standard for a constant acquisition height. When only the previously-described individual radiators are employed in the receive case, the vertical transmit antenna pattern can exhibit an energy drop which is greater than that according to the cosecant-squared law. The transmit antenna can likewise be employed independently of the remaining receive radiators for reception. Due to the broad cosecant-squared lobe, a lasting target connection is then given during the scanning operation of the individual lobe radiator. The additional employment of the transmit antenna as the receive radiator, however, is no longer meaningful when each of the actual receive radiators is connected to its own receiver.

The feed to the individual receivers is unproblematical when the high frequency components of the receivers turn along with the antenna arrangement. When this is not the case, then a multiple rotary joint is advantageously employed whose number of channels depends on the number of individual receivers. The reduction of the number of individual radiators to the number of receivers follows by a switching device which is advantageously arranged above the rotary joint.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
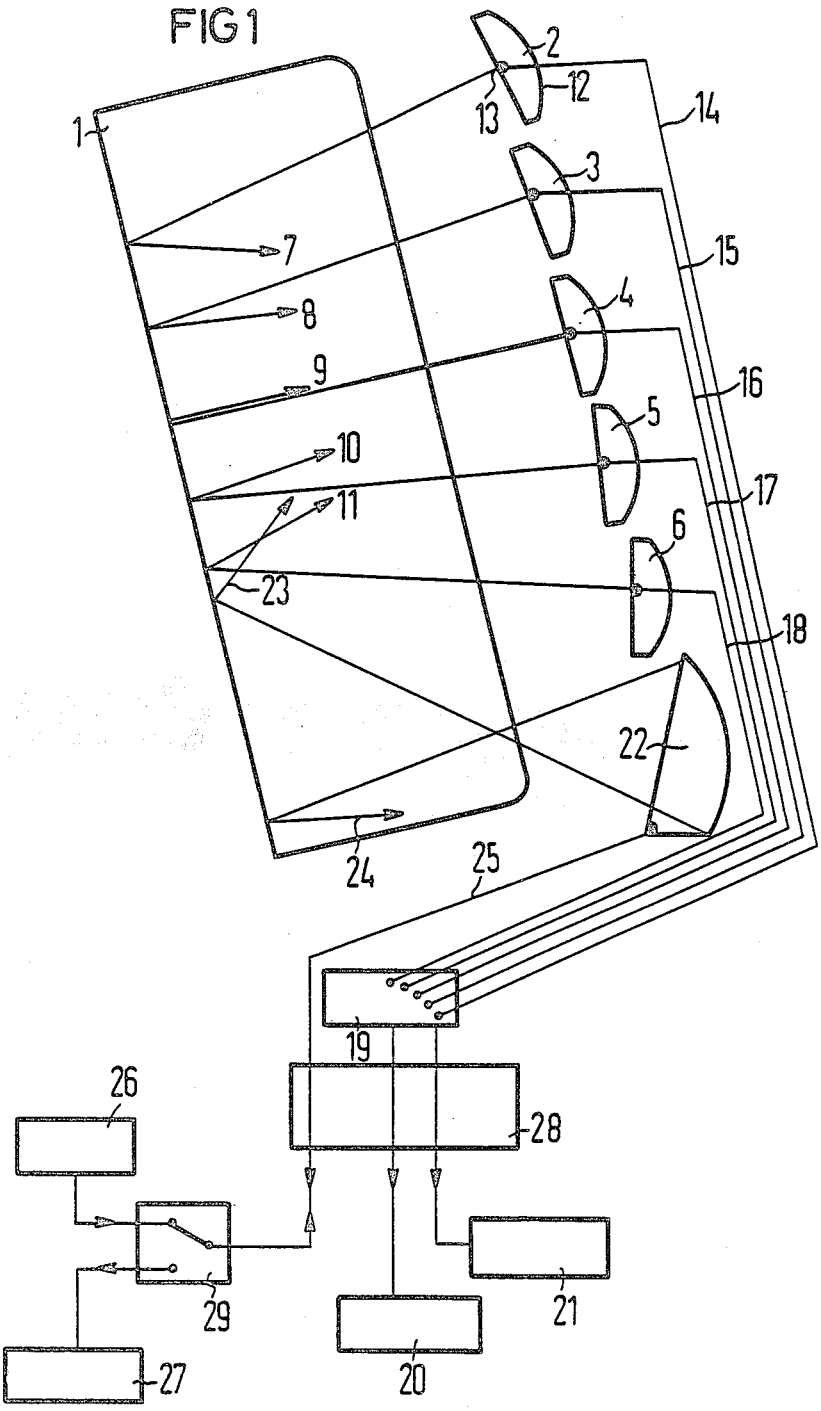
FIG. 1 is a lateral presentation of an antenna operating in accordance with the present invention and having appertaining beam directions.

The antenna arrangement of the present invention schematically illustrated in FIG. 1 in a side view comprises a parabolic cylinder reflector 1 which generates a beam focusing only in the horizontal plane. Individual radiators 2–6 which are narrow in terms of their horizontal extent are arranged along the focal line of the parabolic cylinder reflector 1, the vertical extent of the individual radiators being sufficiently large that a desired bundling of the individual lobes lying above one another arises. The primary radiation directions generated by the individual radiators 2–6 operating as receiving devices are referenced 7–11. The radiators 2–6 are constructed as flat parabolic antennas and comprise metal plates extending parallel to one another which are terminated by a parabolic cylinder strip, for example, the strip 12 at the radiator 2, and which are fed by a small horn radiator, for example, the radiator 13 at the receiving device 2, at the focal point of the parabolic strip by way of a respective lines 14–18. The flat parabolic antennas 2–10 are inclined in the vertical plane in such a manner that the desired vertical primary beam directions 7–11 respectively occur. The supply lines 14–18 of the individual radiators 2–6 are connected to a switching device 19. With the switching device 19, two neighboring individual radiators can be respectively connected in chronological succession to two receivers 20 and 21. The transmission output is beamed out by an additional individual radiator 22 which is likewise designed as a flat parabolic antenna and which also co-employs the parabolic cylinder reflector 1. The individual radiator 22 generates a broad, vertical radiation pattern, for example, a cosecant-squared pattern, this being indicated by the two directional arrows 23 and 24. The supply line to the individual radiator 22 is referenced 25. When, in the receiving case, only the individual radiators 2–6 are used, the transmit antenna pattern can exhibit an energy drop which is greater than that according to the cosecant-squared law. The individual radiator 22 can likewise be employed for receiving independently of the receiving radiators 2–6. Due to the broad antenna lobe in the vertical plane which is generated by the individual radiator 22, a lasting target connection is nevertheless provided by the switching device 19 during the scanning operation of the individual radiators 2–6. Since the transmitter 26 and the two receivers 20 and 21 as well as, under certain conditions, a receiver 27, are designed to be mechanically stationary, a multiple rotary joint 28 is provided whose number of channels depends on the number of receivers. The transmitter 26 and the additional receiver 27 are separately connected to the supply line 25 by way of a duplex switch 29.

Depending on the primary beam directions of the radiators, an interchange of the radiators, for example, of the transmit antenna 22 and the receive radiators 2–6, can be more favorable.

Figure 2:
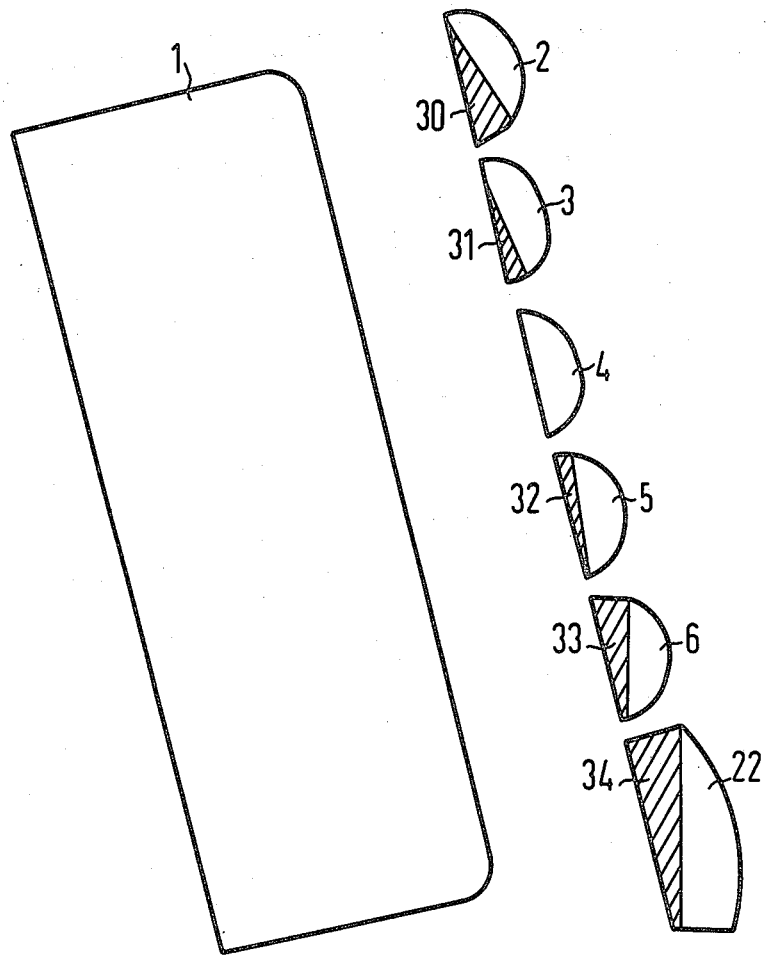
FIG. 2 is a lateral view of an antenna constructed in accordance with FIG. 1, however having aligned apertures of the individual radiators in the primary radiator row.

FIG. 2 illustrates the parabolic cylinder reflector 1 and the individual radiators 2–6, as well as the radiator 22 of the antenna arrangement constructed in accordance with FIG. 1. In FIG. 2, however, the flat parabolic antennas 2–6 and 22, inclined relative to the focal line of the parabolic cylinder reflector 1, are extended at the side of their openings so that the aperture planes contain the focal line of the reflector 1. The extension pieces are illustrated by hatching and are referenced 30–34. An improvement of the azimuthal focusing is achieved by this feature. In the individual radiator 4, the aperture plane already comprises the focal line of the parabolic cylinder reflector 1, so that an extension is not necessary.

Figure 3:
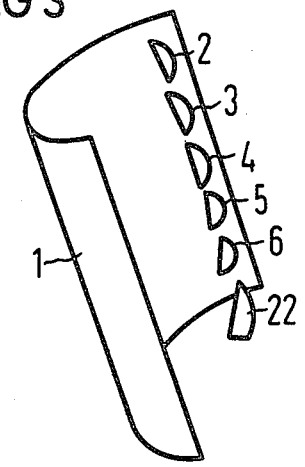
FIGS. 3 and 4 illustrate the position of the primary radar row with respect to the reflector given a symmetrical antenna format in a perspective view or, respectively, in a top view.
Figure 4:
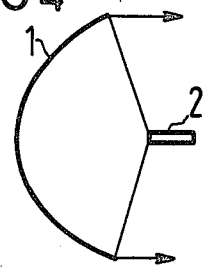

FIGS. 3 and 4 illustrate the position of the primary radiator row with the individual radiators 2–6 and 22 in reference to the parabolic cylinder reflector 1 given a symmetrical antenna format in a perspective view and, respectively, in a top view.

Figure 5:
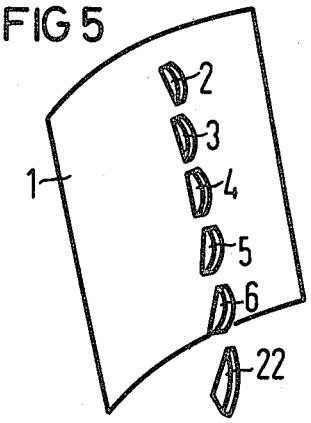
FIGS. 5 and 6 illustrate the position of the primary radiator row with respect to the reflector given an asymmetrical antenna format in a perspective view and, respectively, in a top view.
Figure 6:
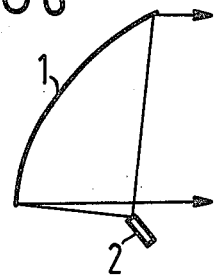

FIGS. 5 and 6 illustrate the position of the primary radiator row comprising the individual radiators 2–6 and the radiator 22 with respect to the parabolic cylinder reflector 1, given an asymmetrical antenna format, likewise in a perspective view and in a top view, respectively. The advantage of the asymmetrical arrangement, i.e. of the so-called offset feed, is that the primary radiator row with the individual radiators 2–6 and 22 lies outside of the beam path after the reflection at the reflector 1 and, therefore, can cause no aperture covering with higher side lobes.

Figure 7:
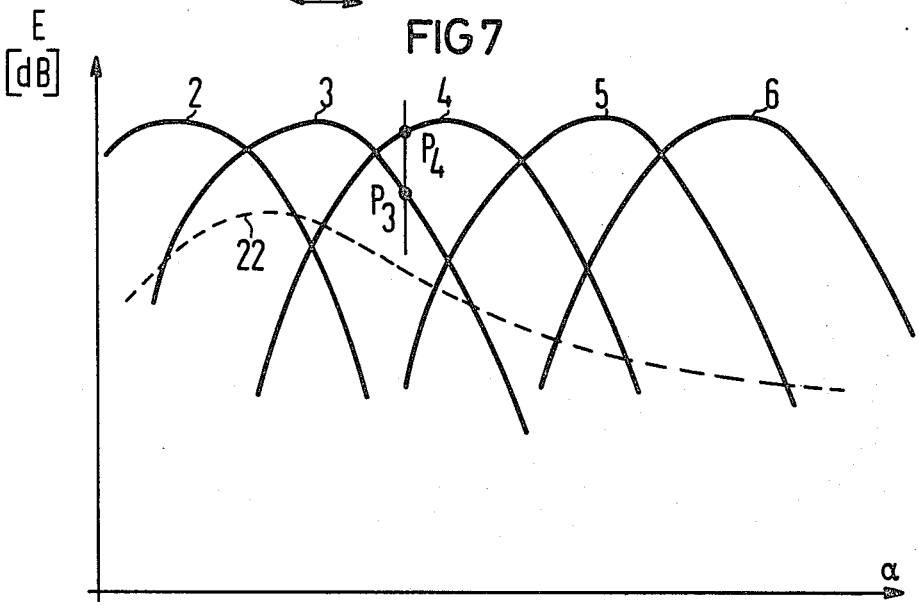
FIG. 7 is a graphical illustration showing the reception level of five individual radiators of the primary radiator row and the cosecant-squared pattern of an additional primary radiator for transmitting and receiving as a function of the respective elevation angle.

FIG. 7, in a diagram, shows the receiving level E of the five individual receive radiators 2–6 of the primary radiator row as a function of the respective elevation angle. Moreover, in a broken line, FIG. 7 illustrates the transmit and, potentially, the receiving level 22 of the individual radiator which generates a cosecant-squared pattern in the vertical plane. Due to the overlap of the primary lobes of neighboring radiators 2–6, the radiator having the highest receive signal roughly indicates the elevation angle of the target given a simplest evaluation. Giving a monopulse evaluation, i.e. given a quantitative level comparison of the received signals of two neighboring radiators, for example, of the radiators 3 and 4 with the levels $P_3$ and $P_4$, a significantly greater precision is achieved in the evaluation of the elevation angle $\alpha$ of the acquired target. The magnitude of the accuracy lies at approximately 1/5–1/10 of the 3dB-beamwidths of the individual lobes.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An antenna arrangement for radar surveillance for target locating having altitude acquisition, comprising:

a parabolic cylinder reflector mounted for rotation about a vertical axis; and a primary radiator row arranged along the focal line of said reflector including a plurality of individual radiators, each of said individual radiators operable with a beam which is narrow in its horizontal extent and all individual radiators inclined in a vertical plane with respect to one another so that their individual lobes lie one above another to form a vertical pattern, and each of said individual radiators including a vertical dimension providing a predetermined bundling of the individual lobes.

2. The antenna arrangement of claim 1, wherein:

each of said individual radiators comprises a flat parabolic antenna which is inclined with respect to the focal line of said parabolic reflector and which includes a pair of parallel metal plates, a metal parabolic cylinder strip terminating said plates, a radiation aperture and a horn radiator mounted on the focal line of said strip.

3. The antenna arrangement of claim 2, wherein:

each of said flat parabolic antenna includes a symmetrical feed.

4. The antenna arrangement of claim 2, wherein:

each of said flat parabolic antenna includes an asymmetrical feed.

5. The antenna arrangement of claim 2, wherein:

each of said flat parabolic antennas includes plate extensions projecting from said metal plates and are mounted such that its aperture plane includes the focal line of the parabolic cylinder reflector.

6. The antenna arrangement of claim 1, wherein:

each of said individual radiators comprises a flat horn radiator.

7. The antenna arrangement of claim 1, wherein:

said individual radiators are symmetrically arranged in front of said parabolic reflector.

8. The antenna arrangement of claim 1, wherein:

said individual radiators are asymmetrically arranged in front of said parabolic reflector.

9. The antenna arrangement of claim 1, and further comprising:

a plurality of radar receivers; and means operable to connect said individual radiators to respective receivers.

10. The antenna arrangement of claim 1, and further comprising:

a radar receiver; and means operable to sequentially connect said individual radiators to said receiver.

11. The antenna arrangement of claim 1, and further comprising:

a pair of radar receivers; and means operable to sequentially connect two adjacent individual radiators to said receiver.

12. The antenna arrangement of claim 1, and further comprising:

an additional primary radiator disposed in front of said parabolic cylinder reflector.

13. The antenna arrangement of claim 1, and further comprising:

an additional primary radiator disposed in front of said parabolic cylinder reflector and operable to produce a vertical transmit pattern in the form of a cosecant-squared pattern.

14. The antenna arrangement of claim 12, wherein:

said additional primary radiator comprises a flat parabolic antenna in the primary radiator row.

15. The antenna arrangement of claim 14, and further comprising:

a radar receiver; and means operable to sequentially connect all of the radiators of the primary radiator row to said receiver.

16. The antenna arrangement of claim 1, and further comprising:

transmitting means;

receiving means; and a rotary joint connecting said transmitter means and said receiver means to said individual radiators.

17. The antenna arrangement of claim 14, wherein:

said receiver means comprises a plurality of receivers;

switching means is provided between said rotary joint and the individual radiators to make the number of receivers less than the number of radiators.

* * * * *